US008459958B2

(12) United States Patent
Renner

(10) Patent No.: US 8,459,958 B2
(45) Date of Patent: Jun. 11, 2013

(54) AUTOMATIC COMPRESSOR OVERPRESSURE CONTROL

(75) Inventor: Ross Renner, Black Creek, WI (US)

(73) Assignee: Illinois Tool Works, Inc., Glenview, IL (US)

( * ) Notice: Subject to any disclaimer, the term of this patent is extended or adjusted under 35 U.S.C. 154(b) by 230 days.

(21) Appl. No.: 12/831,162

(22) Filed: Jul. 6, 2010

(65) Prior Publication Data

US 2011/0052415 A1 Mar. 3, 2011

Related U.S. Application Data

(60) Provisional application No. 61/239,544, filed on Sep. 3, 2009.

(51) Int. Cl.
*F04B 9/00* (2006.01)

(52) U.S. Cl.
USPC ..... 417/18; 417/316; 219/133

(58) Field of Classification Search
USPC ..... 417/18, 316; 219/133
See application file for complete search history.

(56) References Cited

U.S. PATENT DOCUMENTS

| | | | | |
|---|---|---|---|---|
| 1,785,980 | A | 12/1930 | Sanford | |
| 3,495,767 | A | 2/1970 | Zrostlik | |
| 5,114,315 | A | 5/1992 | Kaltenthaler et al. | |
| 6,121,691 | A | 9/2000 | Renner | |
| 6,153,855 | A | 11/2000 | Renner et al. | |
| 6,363,918 | B2 * | 4/2002 | H.ang.kansson et al. | 123/509 |
| 6,469,276 | B1 | 10/2002 | Renner et al. | |
| 6,603,213 | B1 | 8/2003 | Renner | |
| 6,812,584 | B2 | 11/2004 | Renner | |
| 6,812,585 | B2 | 11/2004 | Renner | |
| 2006/0027547 | A1 * | 2/2006 | Silvestro | 219/133 |
| 2008/0047271 | A1 * | 2/2008 | Ingersoll | 60/645 |
| 2008/0264920 | A1 | 10/2008 | Leisner et al. | |
| 2009/0194067 | A1 | 8/2009 | Peotter et al. | |

FOREIGN PATENT DOCUMENTS

| | | | |
|---|---|---|---|
| DE | 3148717 | A1 | 7/1983 |
| WO | 2008067252 | A2 | 6/2008 |

OTHER PUBLICATIONS

International Search Report for application No. PCT/US2010/042903 mailed Dec. 15, 2010.
U.S. Appl. No. 12/367,400, filed Feb. 6, 2009.
U.S. Appl. No. 12/369,558, filed Feb. 11, 2009.
U.S. Appl. No. 12/369,569, filed Feb. 11, 2009.
U.S. Appl. No. 12/781,757, filed May 17, 2010.
U.S. Appl. No. 12/782,665, filed May 18, 2010.

* cited by examiner

*Primary Examiner* — Charles Freay
*Assistant Examiner* — Patrick Hamo
(74) *Attorney, Agent, or Firm* — Fletcher Yoder P.C.

(57) ABSTRACT

The present embodiments provide a system having a motor, a compressor having a compression device configured to increase a pressure of a gas, a clutch configured to selectively transfer torque from the motor to the compressor to drive the compression device, and a controller configured to disengage the clutch if the pressure of the gas in the compressor meets or exceeds a first threshold pressure.

19 Claims, 4 Drawing Sheets

AUTOMATIC COMPRESSOR OVERPRESSURE CONTROL

CROSS REFERENCE TO RELATED APPLICATIONS

This application claims the benefit of U.S. Provisional Patent Application Ser. No. 61/239,544, entitled "AUTOMATIC COMPRESSOR OVERPRESSURE CONTROL", filed on Sep. 3, 2009, which is herein incorporated by reference in its entirety.

BACKGROUND

The invention relates generally to a compressor and, more specifically, an overpressure prevention and control system and method. A compressor may be used in a variety of applications and environmental conditions. Unfortunately, the compressor may be subject to ice formation and/or debris buildup, which can cause one or more valves to stick, causing the compressor to overpressurize shortly after startup.

BRIEF DESCRIPTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

The present embodiments provide a system having a motor, a compressor having a compression device configured to increase a pressure of a gas, a clutch configured to selectively transfer torque from the motor to the compressor to drive the compression device, and a controller configured to disengage the clutch if the pressure of the gas in the compressor meets or exceeds a first threshold pressure.

In another embodiment, a system includes a compressor control system having an overpressure controller, wherein the overpressure controller is configured to selectively engage and disengage a clutch between a motor and a compressor based on a comparison of a sensed pressure with at least one threshold pressure.

The present embodiments further provide a method including selectively disengaging a clutch between a motor and a compressor if a sensed pressure meets or exceeds a first threshold pressure in the compressor, and selectively engaging the clutch if the sensed pressure is at least less than the first threshold pressure in the compressor.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As discussed below, embodiments of the present technique provide a uniquely effective solution to pressure management in compressors. Thus, the disclosed embodiments relate or deal with any application where a compressor is powered, such as by a compression ignition or spark ignition engine, and the load or combination of loads are intermittently applied to the engine. In certain embodiments, the disclosed pressure management techniques may be used with various service packs to prevent an over pressure condition of a compressor.

As discussed below, the present embodiments utilize pressure sensing from the compressor, thereby providing feedback to a controller and/or user to control and/or release pressure within a compressor in an overpressure situation. For example, during cold weather, such as on a snowy or cold and rainy day, there may be an accumulation of ice internal to the compressor, such as on a valve that is configured to control the pressure within the compressor (or compressor tank). In such a situation, the compressor may continue to pressurize and reach a pressure that is beyond a regulated set point. In such an overpressure situation, the compressor may reach a pressure sufficient to activate a manual pressure relief valve, which can result in oil or other lubricants being expelled form the compressor. Rather than rely on such a manual valve, a controller configured according to the present embodiments may disable a clutch that is drivingly coupled the compressor to stop pressurization. The disabling may be performed at a number of different set points, such as pressures, as described below. As an example, the controller may disengage the clutch from the compressor at pressures of approximately 180 psi. In some embodiments, the pressure set point may be about 20, 30, 40 psi or more lower than the pressure at which the manual relief valve is activated. It should be noted that the pressures at which the clutch is disabled may be determined based upon manufacturing specifications, or may be user-defined.

Figure 1:
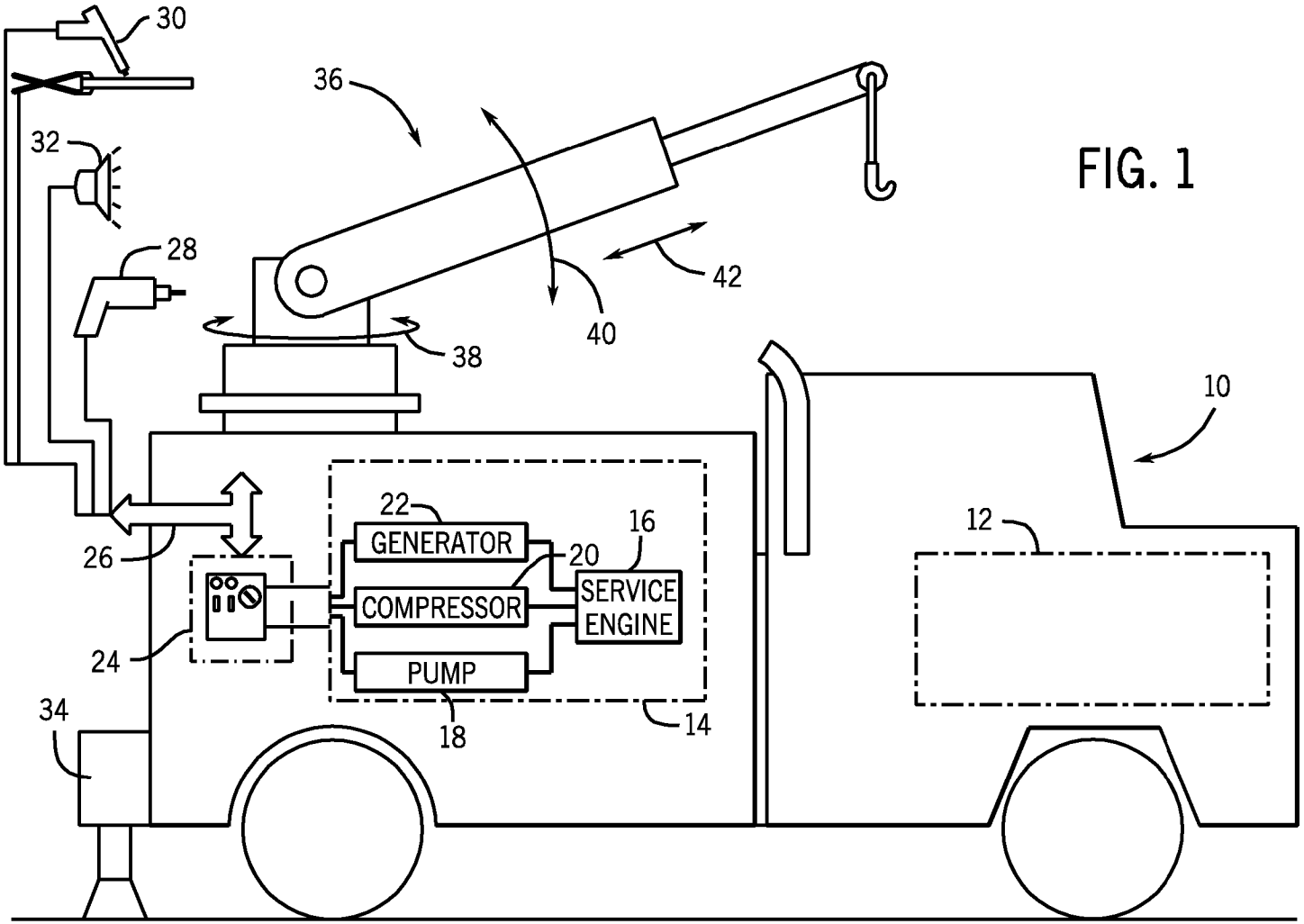
FIG. 1 is a diagrammatical overview of a work vehicle having a service pack with a compressor configured to be disengaged from a service engine in overpressure situations to prevent compressor malfunction, in accordance with aspects of the present embodiments is installed.

As noted above, the present embodiments of a control system that is configured to disable a clutch coupled to the compressor is applicable to a variety of implementations, including work vehicles. FIG. 1 illustrates such a work vehicle 10 including a main vehicle engine 12 coupled to a service pack module 14. The service pack 14 includes equipment that is capable of providing resources such as electrical power, compressed air, and hydraulic power. The equipment may be powered with or without assistance from the main vehicle engine 12. For example, a service engine 16 may power the service pack 14. Thus, in some embodiments, the operator can shut off the main vehicle engine to reduce noise, conserve fuel, and increase the life of the main vehicle engine 12, as the service engine 16 is typically smaller and thus, consumes less fuel. As an example, the service pack engine 16 may include a spark ignition engine (e.g., gasoline fueled internal combustion engine) or a compression ignition engine (e.g., a diesel fueled engine), for example, an engine with 1-4 cylinders with approximately 10-80 horsepower.

The service pack 14 may have a variety of resources, such as electrical power, compressed air, hydraulic power, and so forth. In the illustrated embodiment, the service pack 14 includes a pump 18. In particular, the pump 18 may include a hydraulic pump, a water pump, a waste pump, a chemical pump, or any other fluid pump. According to present embodiments, the service pack 14 includes an air compressor 20 as well as a generator 22. The air compressor 20 and the generator 22 may be driven directly, or may be belt, gear, or chain driven, by the service engine 16 or one or more motors to which the service engine 16 and/or the pump 18 is coupled (e.g., a hydraulic motor). The generator 22 may include a three-phase brushless type, capable of producing power for a wide range of applications. However, other generators may be employed, including single phase generators and generators capable of producing multiple power outputs. The air compressor 20 may be of any suitable type, such as a rotary screw air compressor and the like. Other suitable air compressors might include reciprocating compressors, typically based upon one or more reciprocating pistons. It should be noted that the air compressor 20 contains one or more solenoid valves, such as a main control valve, that may be disengaged in order to prevent compressor malfunction, as discussed below.

The service pack 14 includes conduits, wiring, tubing, and so forth for conveying the services/resources (e.g., electrical power, compressed air, and fluid/hydraulic power) generated to an access panel 24. The access panel 24 may be located on any portion of the vehicle 10, or on multiple locations in the vehicle, and may be covered by doors or other protective structures. In one embodiment, all of the services may be routed to a single/common access panel 24. The access panel 24 may include various control inputs, indicators, displays, electrical outputs, pneumatic outputs, and so forth. In an embodiment, a user input may include a knob or button configured for a mode of operation, an output level or type, etc. According to the embodiments described herein, at least one controller is present in or operatively coupled to the access panel 24. The controller is able to disengage the air compressor 20 from the service engine 16 (by disabling a clutch) to prevent the compressor 20 from over pressurizing due to the presence of contaminants, such as ice, particulate matter, etc. In performing the disablement, the controller may substantially reduce or eliminate malfunction of the compressor 20 due to over pressurization. The controller may control all or a part of the service pack 14, which, as noted above, supplies electrical power, compressed air, and fluid power (e.g., hydraulic power) to a range of applications designated generally by arrows 26.

As depicted, air tool 28, torch 30, and light 32 are applications connected to the access panel 24 and, thus, the resources/services provided by the service pack 14. The various tools may connect with the access panel 24 via electrical cables, gas (e.g., air) conduits, fluid (e.g., hydraulic) lines, and so forth. The air tool 28 may include a pneumatically driven wrench, drill, spray gun, or other types of air-based tools that receive compressed air from the access panel 24 and compressor 20 via a supply conduit (e.g., a flexible rubber hose). The torch 30 may utilize electrical power and compressed gas (e.g., air or inert shielding gas) depending on the particular type and configuration of the torch 30. For example, the torch 30 may include a welding torch, a cutting torch, a ground cable, and so forth. More specifically, the welding torch 30 may include a TIG (tungsten inert gas) torch or a MIG (metal inert gas) gun. The cutting torch 30 may include a plasma cutting torch and/or an induction heating circuit. Moreover, a welding wire feeder may receive electrical power from the access panel 24.

The fluid system of the service pack 14, such as the pump 18, hydraulically powers a vehicle stabilizer 34. The vehicle stabilizer 34 operates, for example, to stabilize the work vehicle 10 at a work site when heavy equipment is used. Such equipment may include a hydraulically powered crane 36 that may be rotated, raised and lowered, and extended (as indicated by arrows 38, 40 and 42, respectively). Again, the service pack 14 may provide the desired resources/services to run various tools and equipment without requiring operation of the main vehicle engine 12.

The vehicle 10 and/or the service pack 14 may include a variety of protective circuits for the electrical power, e.g., fuses, circuit breakers, and so forth, as well as valving for the hydraulic and air service. For the supply of electrical power, certain types of power may be conditioned (e.g., smoothed, filtered, etc.), and 12 volt power output may be provided by rectification, filtering and regulating of AC output. Valving for fluid (e.g., hydraulic) power output may include by way example, pressure relief valves, check valves, shut-off valves, as well as directional control valving. Moreover, the air compressor 26 may draw air from the environment through an air filter and the pump 16 may draw fluid from and return fluid to a fluid reservoir.

Depending upon the system components selected and the placement of the service pack 14, reservoirs may be provided for storing fluid (e.g., hydraulic fluid) and pressurized air as noted above. However, the fluid reservoir may be placed at various locations or even integrated into the service pack 14. In one embodiment, as noted above, the air compressor 20 may contain one or more valves (e.g., a main control valve and/or a main intake valve) that are susceptible to freeze-up due to ice formation in cold conditions and/or debris buildup. In embodiments where ice buildup (or a similar contaminant) freezes the main intake valve, the pressure within the air compressor 20 may cause a pressure relief valve to open, may cause the air compressor 20 to shut down, or, in some situations, may cause the service pack 14 to shut down altogether. In contrast, the present embodiments provide for the main intake valve to be shut off via disengagement of the compressor 20 (e.g., disengagement of the clutch) from the service engine 16 to prevent compressor malfunction without (or prior to) opening the pressure relief valve and/or shutting down the engine. Thus, it should be noted that the compressor 20 may continue to operate even though compression is not being performed. In other words, the engine continues to run, and compressed air can be obtained from the compressor 20. Additionally, a user-perceivable indication may be provided that the compressor 20 is in an overpressure situation. For example, one or more flashing lights, audible alarms, tactile indications, and so on may notify a user that the compressor 20 has pressurized beyond a set point. In response to such notifications, the user may utilize the air that the compressor 20 has compressed to reduce the pressure within the compressor 20. Thereafter, the controller may re-engage the compressor 20 with the clutch (and therefore the service engine 16). Such a cycle may be performed until the compressor 20 generates sufficient heat to unfreeze any frozen valves or other working components.

In use, the service pack 14 provides various resources/services (e.g., electrical power, compressed air, fluid/hydraulic power, etc.) for the on-site applications completely independent of vehicle engine 12. For example, the service pack engine 16 generally may not be powered during transit of the vehicle from one service location to another, or from a service garage or facility to a service site. Once located at the service site, the vehicle 10 may be parked at a convenient location, and the main vehicle engine 12 may be shut down. The service pack engine 16 may then be powered to provide auxiliary service from one or more of the service systems described above. Where desired, clutches, gears, or other mechanical engagement devices may be provided for engagement and disengagement of one or more of the generator 22, the pump 18, and the air compressor 20.

Figure 2:
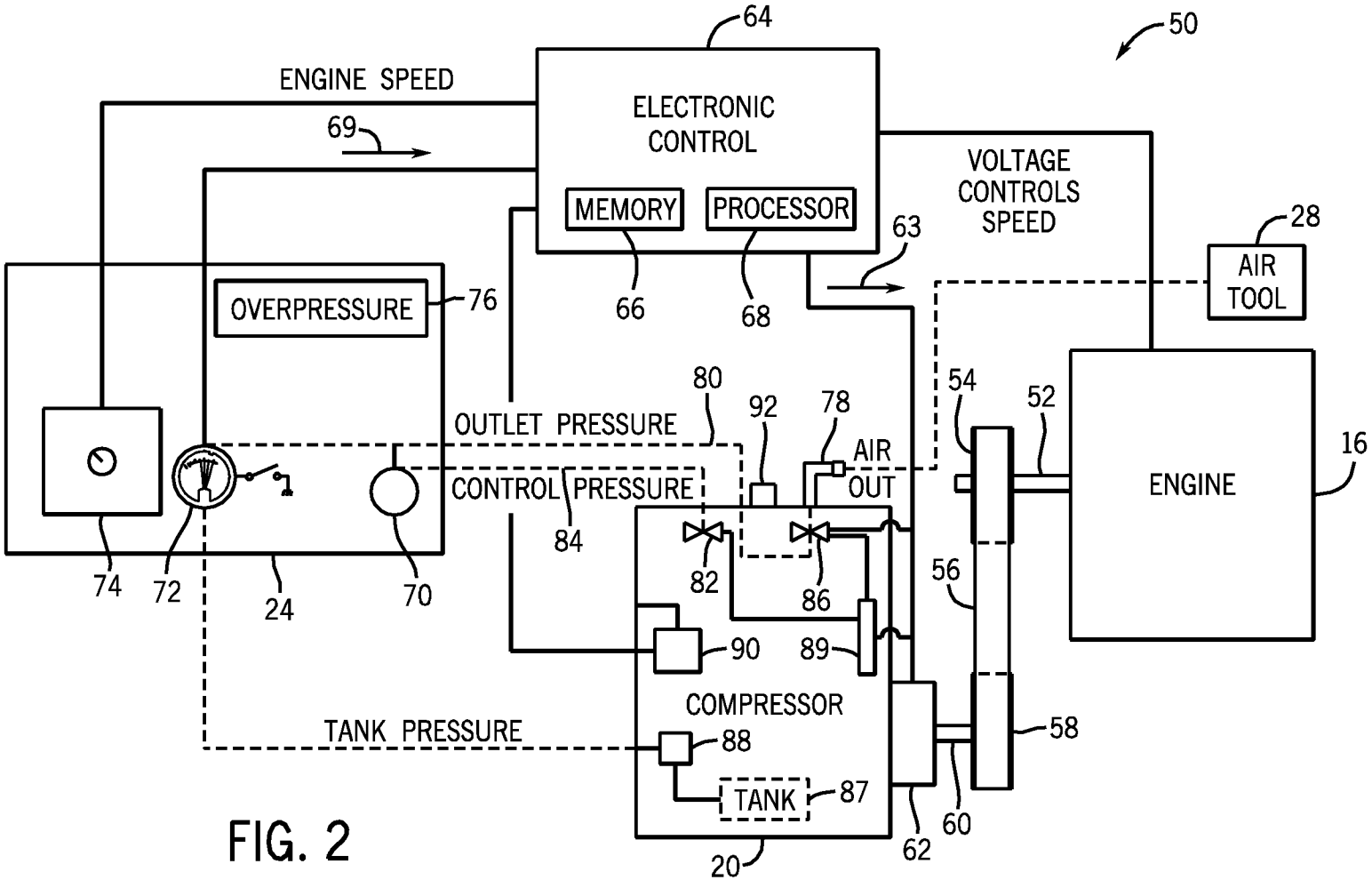
FIG. 2 is diagrammatical representation of a compression and control system that is configured to disable a clutch in response to compressor overpressure, in accordance with present embodiments.

FIG. 2 is a block schematic illustrating an embodiment of a control and monitoring system 50 wherein pressure, flow, or other operation parameters of the air compressor 20 are controlled or regulated directly on the control panel 24. It should be noted that the control and monitoring system 50 may be a part of the service pack 14, which may be part of the work vehicle 10 of FIG. 1 or may be a self-contained service pack including the pump 18, the compressor 20, and the generator 22. In embodiments where the service pack 14 is self-contained, such components may be partially or substantially completely driven by the service engine 16. In the illustrated embodiment, the air compressor 20 is drivingly coupled to the engine 16 via a belt and pulley system including stub shaft 52, a pulley 54, a drive belt 56, a compressor pulley 58, and the compressor drive shaft 60. In the illustrated embodiment, the engine 16 rotates the stub shaft 52 to transmit rotation and torque via the pulleys 54 and 58 and drive belt 56 to the compressor drive shaft 60 coupled to the air compressor 20. Accordingly, the mechanical energy generated by the engine 16 operates the air compressor 20. Additionally, a clutch 62 is provided between the engine 16 and the compressor 20. The clutch 62 is generally configured to enable engagement and disengagement of the compressor 20 with the compressor pulley 58 and, in turn, the engine 16. For example, the clutch 62 may include an electromagnetic clutch, a wet clutch, or another suitable clutch configuration. According to present embodiments, the clutch 62 may be disengaged from the compressor 20 in situations where the compressor 20 reaches a pressure beyond a set point, as described below.

More specifically, the clutch 62 may be disengaged via a control signal 63 from control circuitry 64 having a processor 68 and memory 66. Therefore, in one embodiment, the control circuitry 64 may be an overpressure controller. The processor 68 may be configured to perform one or more control routines, such as control routines where the clutch 62 is disabled when a pressure transducer signal 69 received by the control circuitry 64 is indicative that the compressor 20 has reached a set point. Other feedback mechanisms contemplated herein that may cause the control circuit 64 to disengage the clutch 62 may include vibration, high temperature, low temperature, coolant levels, and so forth within the compressor 20. In a general sense, any feedback indicative of a possible overpressure situation which can result in damage to the compressor 20, or damage already done to the compressor 20, is contemplated. For example, vibration may be indicative of damaged bearings, seals, and so forth, temperature may be indicative of increased friction resulting from damaged bearings or seals, and so on. All of these and similar feedback mechanisms are contemplated herein. Routines for engaging/re-engaging the clutch 62 and corresponding set points (e.g., pressure thresholds) may be stored on the memory 66 and accessed where appropriate by the processor 68. The control circuitry may access and perform analysis routines, such as comparisons, between the received feedback and a threshold value, which may result in disengagement of the clutch 62. The control circuitry 64 may also control and/or monitor other portions of the system 50. Additionally, the control circuitry 64 may be addressed by an operator through the control panel 24. In this embodiment, the control panel 24 includes a regulator 70, a pressure gauge 72, and one or more user inputs 74, which may be used to monitor, regulate, or generally control various features of the air compressor 20. For example, the regulator 70 enables tool-free control of the air pressure of the air compressor 20, obviating the need for special tools to perform such tasks. The ability to control pressure via the regulator 70 also substantially reduces or altogether eliminates the need for accessing internal components of the system 10 or other more time consuming tasks to adjust such operational parameters. Indeed, an operator may work in conjunction with the control circuitry 64 to open one or more valves to reduce the pressure within the compressor 20, as discussed below. As an example, the user may adjust the pressure within the compressor 20 in a manner that provides finer control over pressurization rates, heating rates, and so forth, than would be available with normal operation of the compressor 20. Further, the user may use the control panel 24 to adjust pressure set points, clutch disable thresholds, minimum pressure requirements for re-engagement of the clutch 62, and so forth.

As an example, a user may desire to provide one or more sensors in or around the compressor 20, as discussed below. The one or more sensors may have respective monitoring and control circuitry, which the user may interface with the access panel 24 as the inputs 74. Generally, the inputs 74 may include one or more knobs, buttons, switches, keypads, or other devices configured to select an input or display function, as discussed further herein. The control panel 24 may include one or more display devices 76, such as an LCD display, to provide feedback to the operator. According to the present embodiment, the display device 76 may provide a visual indication that allows the user to be informed that the compressor 20 may be in an overpressure situation. The display may be an LED readout that may display one or more messages, such as "OVERPRESSURE," "ATTENTION," "MALFUNCTION," and so on. Further, the visual indication may include flashing indications, such as a flashing bulb, flashing notifications, etc. In addition to or in lieu of such visual indications, other user-perceivable indications may be provided. For example, an audible indication may be provided, such as a tone or voice alarm, or a tactile indication may be provided, such as vibration of one or more components that may be in contact with the user. Therefore, it should be noted that the control panel 24 is not limited to the components described herein, and may include any number of components as desired or required for monitor or control of the system 50, such as multiple user inputs, display devices, gauges, speakers, readouts, LCD displays, LED displays, etc.

The air compressor 20 includes an outlet connection 78 for connection to air-operated devices, such as plasma cutters, impact wrenches, drills, spray guns, lifts, or other pneumatic-driven tools, such as those described above with respect to FIG. 1. Additionally, an outlet pressure line 80 is connected to the regulator 70 and the pressure gauge 72. An inlet valve 82 is located at the inlet of the air compressor 20. A control pressure line 84 is connected from the inlet valve 82 to the regulator 70 to provide for control of the pressure generated by the air compressor 20. A main control valve 86, such as a solenoid-driven valve, controls the amount of compressed (pressurized) gas that flows out of the compressor 20. As noted above, situations may arise in which the inlet valve 82 may become frozen or stuck prior to compressor startup. In such a situation, upon starting, the compressor 20 may continually compress air that is entering through the inlet valve 82, which may cause the compressor 20 to overpressure. According to the present embodiments, rather than shutting the compressor 20 down when reaching a set pressure, the clutch 62 is disabled such that the compressor 20 is unable to be driven by the service engine 16. In such configurations, the compressor 20 is not shut down, but is stopped from further compressing air and thus, pressurizing. The compressor 20 may remain inactive until a user engages the main control valve 86 to utilize the stored and compressed air, for example, compressed air stored within a tank 87. Once the compressed air within the tank 87 has been depleted, such that the pressure within the compressor 20 has reached a set pressure level, the clutch 62 may be re-enabled, which allows the compressor 20 to continue compressing air. Accordingly, it should be noted that the compressor 20 may include one or more pressure transducers 88 that are generally configured to provide a signal back to the gauge 72 and thus, the control circuitry 64. For example, the pressure transducer 88 in the illustrated embodiment may be a pressure sensor that is linear with pressure (i.e., has a linear response to pressure). As mentioned above, it should be noted that the compressor 20 is still operable to the extent that pressure is not released to the atmosphere (e.g., pressure is still available). Further, the drive of the compressor 20 (e.g., engine 16) remains running and will re-engage the compressor 20 when pressure falls. In this way, the compressor 20 does not stop providing compressed air, and thus continues to operate for its intended purpose despite the malfunction.

The compressor 20 may also provide a heating element 89 and a temperature sensor 90 for heating an area of the compressor 20 in response to measured temperatures and overpressure situations. For example, when appropriate, a user may activate a heating system at the access panel 24 (such as via the inputs 74), or the control circuitry 64 may automatically activate the heating system based on temperature measurements performed by the temperature sensor 90, automatically upon startup, in response to a pressure exceeding a given threshold, and so on to reduce or prevent a low temperature freeze condition. As the control circuitry 64 may contain algorithms or logic that are configured to perform such temperature control, in some embodiments the control circuitry 64 may be considered a temperature controller. Such heating may be desirable when the compressor 20 is deployed in cold weather and has a possibility to over pressurize, such as in icy, rainy, and/or snowy conditions, when the possibility that ice has built up or will build up. In another embodiment, by continually running the compressor 20, even after it has over pressurized, the heat generated by the compressor 20 may be sufficient to un-freeze the valves 82, 86, such that the heating element 88 may be excluded. Further, a combination of continual running of the compressor 20 as well as heating is also contemplated to speed up the process of freeing the frozen valves 82, 86.

During normal continual operation of the compressor 20, the regulator 70 is configured to regulate the pressure within the compressor 20 via the outlet pressure line 80 and the control pressure line 84. Thus, as the control circuitry 64 performs the actions described herein, an operator can visualize the current pressure provided by the compressor 20 via the pressure gauge 72, and then adjust the pressure up or down via the regulator 70 if desired. An operator may desire to decrease the pressure generated by the compressor 20 to enable the generator 22 (FIG. 1) to draw more mechanical power from the engine 12 to increase electrical power, for example, to increase the electrical power supplied to a plasma cutter. An operator may use the gauge 72 and the regulator 70 to ensure the pressure generated by the compressor 20 stays within the operating pressure range of the plasma cutter, while at the same time reducing the pressure to provide more power to the plasma cutter. Additionally, an operator may control an air flow rate by adjusting the speed of the engine 16 using the control circuitry 64 described above. An operator may also control the speed of the engine 16 by adjusting the user inputs 74 on the control panel 24. Thus, by controlling both air pressure through the regulator 70 and engine speed/air flow through the user inputs 74, an operator may select the air requirements suitable for a plasma cutter, air tool, or other device connected to the system 10 in addition to adjusting set points for clutch disabling and re-enabling.

The pressure gauge 72 may be any type of pressure gauge having a measurement range suitable for the range of pressures generated by the air compressor 20. The illustrated pressure gauge 72 includes an analog face having marks corresponding to pressure values that may be any desired unit of measurement, such as PSI, atm, bar, Pascals, mmHg, etc. The face of the pressure gauge 72 may include designated regions showing the operating pressure ranges of different air-operated devices connected to the air compressor 20 as well as the designated pressures for performing clutch disabling (e.g., at pressure set points). Indeed, in one embodiment, the gauge 72 may also provide a form of control, such that adjusting clutch disable pressure set points on the gauge 72 adjusts the amount of compressed air stored in the tank 87, as well as the pressure at which the clutch 62 is re-enabled after the compressed air stores are depleted. Additionally, the designated regions may show a maximum or critical pressure beyond which the air compressor 20 may not be safely operated. For such pressures, the system 50 also may include an automatic shutoff control to disengage the compressor 20 from the engine 12, or shutoff the engine 12, or release pressure from the compressor 20, or a combination thereof, if a critical pressure is reached or exceeded as indicated on the gauge 72, for example as a back-up when the controls for disengaging the clutch 62 fail to stop the compressor 20 from pressurizing.

As discussed above, the air compressor 20 has a range of operating pressures depending on the size of the components of the compressor 20, such as the case, inlet and outlet valves, the tank 87, or the compression mechanism. The top end of this operating pressure range indicates a maximum or critical pressure that may increase wear or cause damage to the compressor 20 or other components of the system 10. For example, in one embodiment, the compressor 20 may have a maximum or critical pressure of 210 PSI. If the operating pressure of the air compressor 20 exceeds this pressure, for example due to failure of the clutch disabling mechanism, then internal components of the air compressor 20, the housing of such internal components, or the air compressor 20 may be damaged. In addition, internal oil pressures may also reach a critically high level, resulting in oil blowback and damage to internal seals.

To prevent damage to the compressor 20 or any other part of the service pack 14 or vehicle 10 in such a situation, the illustrated air compressor 20 includes a mechanical overpressure valve 92 that is configured to open if the pressure of the compressor 20 exceeds the maximum or critical pressure. The valve 92 provides a relief point that opens to reduce the possibility of potential damage associated with exceeding the maximum or critical pressures. Instead of a critically high pressure causing blowback through the compressor 20 or damaging internal components, the pressure will be relieved through the opening of the valve 92. In some embodiments, the valve 92 may be a pop-off valve or similar release valve capable of relieving built-up pressure. In some embodiments, the overpressure valve 92 may be a check valve that automatically opens upon reaching a critical or threshold pressure. In a further embodiment, the overpressure valve 92 may be controlled by the control circuitry 64 e.g., via a control signal.

As the air compressor 20 may undergo periods of little to no use, it may be useful for the operator to know how long the compressor has been turned off or inactive. In knowing how long the compressor 20 has been inactive, in lieu of the control circuitry 64, a user may manually disable the clutch 62 to prevent the compressor 20 from over pressurizing. Advantageously, the control system 50 provides for storage of the hours of operation and periods of inactivity of the air compressor 20. The memory 66 of the control circuitry 64 may be configured to store the duration of operation and/or inactivity of the compressor 20, a predetermined service and/or maintenance time interval, temperatures sensed within the period of inactivity, pressure fluctuations during the period of inactivity, and the likelihood of valve freezing as determined by the processor 68. The duration of inactivity of the compressor 20 may be determined from the engagement of the clutch 62 (or lack thereof). The control circuitry 64 monitors the duration of the engagement or lack thereof of the electronic clutch 62 and stores that value as the duration of operation/inactivity of the compressor 20. The duration may be stored as any unit of time, such as hours, minutes, etc, and the processor 68 may include functions for converting between different units of time. Predetermined likelihoods of possible over pressurization may be stored in the memory 66 during programming of the control circuitry 64. The processor 68 may compare the stored duration of inactivity of and the temperatures and/or pressure fluctuations sensed within the compressor 20 to the typical conditions for ice or contaminant buildup and calculate the likelihood that the compressor 20 may over pressurize after startup.

In automatic operation, based on the determination, the processor 68 may execute one or more algorithms stored on the memory 66 that are capable of performing the clutch disabling, as noted above. The display device 76 may display the stored duration of inactivity of the compressor 20 and the predetermined likelihood of over pressurizing. Additionally, the user's input (via input 74) of preferred conditions for automatic clutch disabling and/or the preferred conditions for notification for manual pressure release may be displayed on the display device 76. For example, in one embodiment, the user input 74 may be a knob that provides selection of either the duration of inactivity of the compressor 20 or a percentage likelihood that contaminants such as ice are present, which may lead to over pressurizing. The control panel 24 also provides for resetting the user's inputs, through operation of the user input 74 and/or additional user inputs on the control panel 24. In this manner, the user may activate or deactivate automatic clutch disabling processes where desirable.

As noted above, the present embodiments are directed towards disabling the clutch 62 that is drivingly coupled to the compressor 20 to prevent and/or control overpressure situations due, for example, to a frozen intake valve. After the clutch 62 is disabled, the compressor 20 may remain inactive until a user reduces the pressure within the compressor 20 to a set level. During this time, compressed air remains available and thus the compressor 20 still functions for its intended purpose. Once at or below the set pressure level, the clutch 62 re-engages, which allows the compressor 20 to further compress air. This cycle is repeated as many times as suitable for the compressor 20 to build sufficient heat to unfreeze or unstick any valves or moveable components. While the acts described above are provided in the context of a service pack, for example a pack able to provide hydraulic power, electrical power and the like, it should be noted that the approaches described herein may be applicable to a variety of compressors. Accordingly, in addition to the systems described above which are configured to perform clutch disabling, the embodiments described herein also provide a method 100 of operating a compressor after startup. It should be noted that the control circuitry 64 described above may generally perform the acts described herein, in addition to or in lieu of operator intervention.

Figure 3:
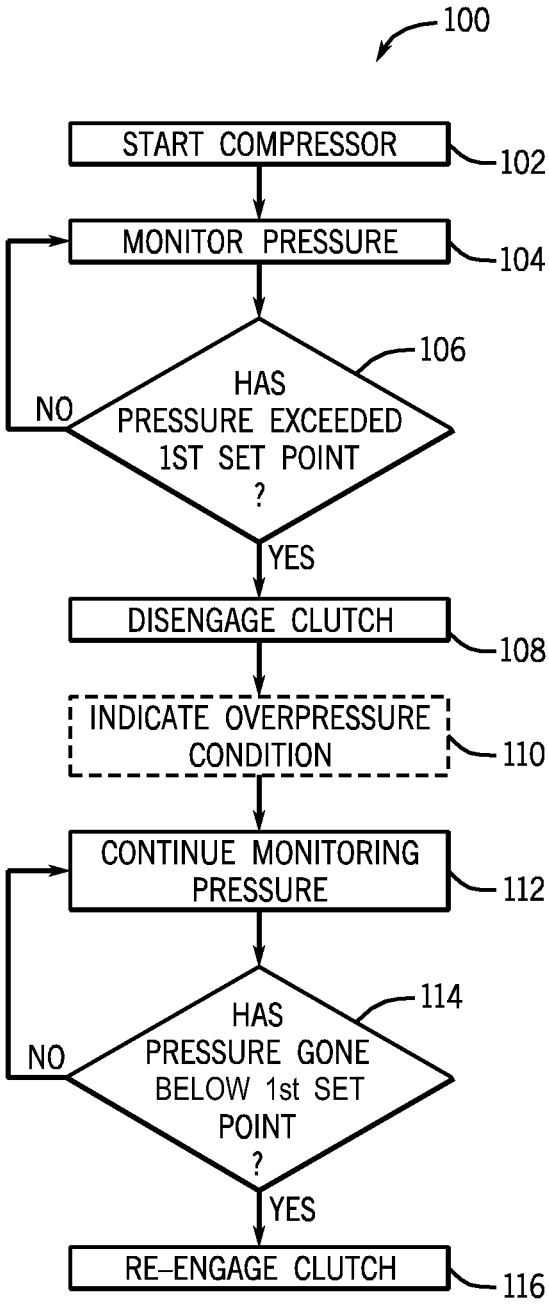
FIG. 3 is a process flow diagram of an embodiment of a method for operating a compressor in response to an overpressure situation.

More specifically, the method 100, illustrated as a process flow diagram in FIG. 3, is provided for preventing compressor over pressurization or, alternatively, for mitigating the effect of such over pressurization on the operation of the compressor 20. Therefore, the method 100 begins with starting the compressor 20 (block 102), for example by a keyed ignition, a start button (for example, located on the compressor 20 or the access panel 24 of FIGS. 1-2), or similar feature. The pressure is then monitored (block 104), for example, by a pressure transducer (e.g., pressure transducer 88 in FIG. 2), that is configured to provide a signal indicative of the current pressure within the compressor 20 to a controller or similar feature, such as control circuitry 64. The compressor 20 (e.g., the processing component 68 of control circuitry 64) may then determine whether the pressure in the compressor 20 has reached the first set point (query 106). For example, the control circuitry 64 may compare the signal 69 indicative of the pressure within the compressor 20 to the first set point. According to present embodiments, the first set point may be a pressure that is lower than the pressure at which a mechanical overpressure valve may be triggered. The first set point may be a percentage of the critical pressure of the compressor 20, such as approximately 85, 90, or 95% of the critical pressure. Further, the first set point may by a similar percentage lower than a second pressure set point, such as a set point at which the mechanical overpressure valve may open. In such a case, the first set point may be at approximately 85, 90, 95, or 99% of the pressure at the second set point. For example, the first set point may be at a pressure of between approximately 120 and 190 PSI, such as 120, 130, 140, 150, 160, 170, 180, or 190 PSI. In one embodiment, the first set pressure may be about 180 PSI.

In situations where the compressor 20 has not yet reached the first set point, the method 100 cycles back to monitoring the pressure (block 104). In situations where the first set point has been reached, such as when the pressure has exceeded the set pressure between approximately 120 and 190 PSI, the method 100 progresses to disengaging the clutch 62 that is drivingly coupled to the compressor 20 (block 108) as described above. Thus, the disengaged clutch does not transfer torque from the engine 16 to the compressor 20. By disengaging the clutch 62, the compressor 20 may not be turned off completely, which may result in faster warming of the compressor 20. In this way, the warm, compressed air is not released into the atmosphere, but rather it remains available from the compressor 20. Such warming may allow any frozen valves (such as the intake valve 82 or the outlet valve 88) to unfreeze, as described below. It should also be noted that disengaging the clutch 62 may signal a heating element (such as the heating element 89 in FIG. 2) to provide heat to the compressor 20 to aid in unfreezing any frozen valves.

Substantially simultaneously or subsequent to the clutch 62 being disengaged (block 108), the compressor 20 may indicate an overpressure condition (block 110), such as by providing a user-perceivable indication. As noted above, the user-perceivable indication may be auditory, such as an audible alarm, visual, such as a constant or blinking display, or tactile, such as by a vibrating piece of equipment that may be in contact with the user. While the indication may be provided substantially simultaneously or subsequent to the disengagement (block 108), providing the indication before the disengagement is also contemplated.

Nevertheless, after the clutch 62 is disengaged (block 108), the method 100 then provides for the compressor 20 to continue monitoring the pressure, for example within the tank 87 (block 112). During the monitoring process, another determination is made as to whether the pressure within the compressor 20 has dropped below the first set point (query 114). According to present embodiments, the determination may include whether the pressure has dropped a certain percentage below the first pressure set point, such as at least approximately 1%, 5%, 10% or more. As an example, if the first pressure set point is between approximately 120 and 190 PSI, then the determination may be affirmative if the pressure has reached at least between approximately 100 and 180 PSI. In one embodiment where the first set point is 180 PSI, the determination may be affirmative if the pressure has reached 175 PSI.

It should be noted that in situations where the compressor 20 has not gone below the first set point, the method 100 cycles back to continue monitoring pressure (block 112). However, in situations where the compressor 20 has indeed gone below the first set point, the compressor 20 may then re-engage the clutch (block 116) for normal compressor operation. As noted above, the pressure may go below the first set point after the user has applied a load to the compressor, such as by using an air tool that depletes the compressed air that is stored within the compressor 20 (for example, within the tank 87).

Figure 4:
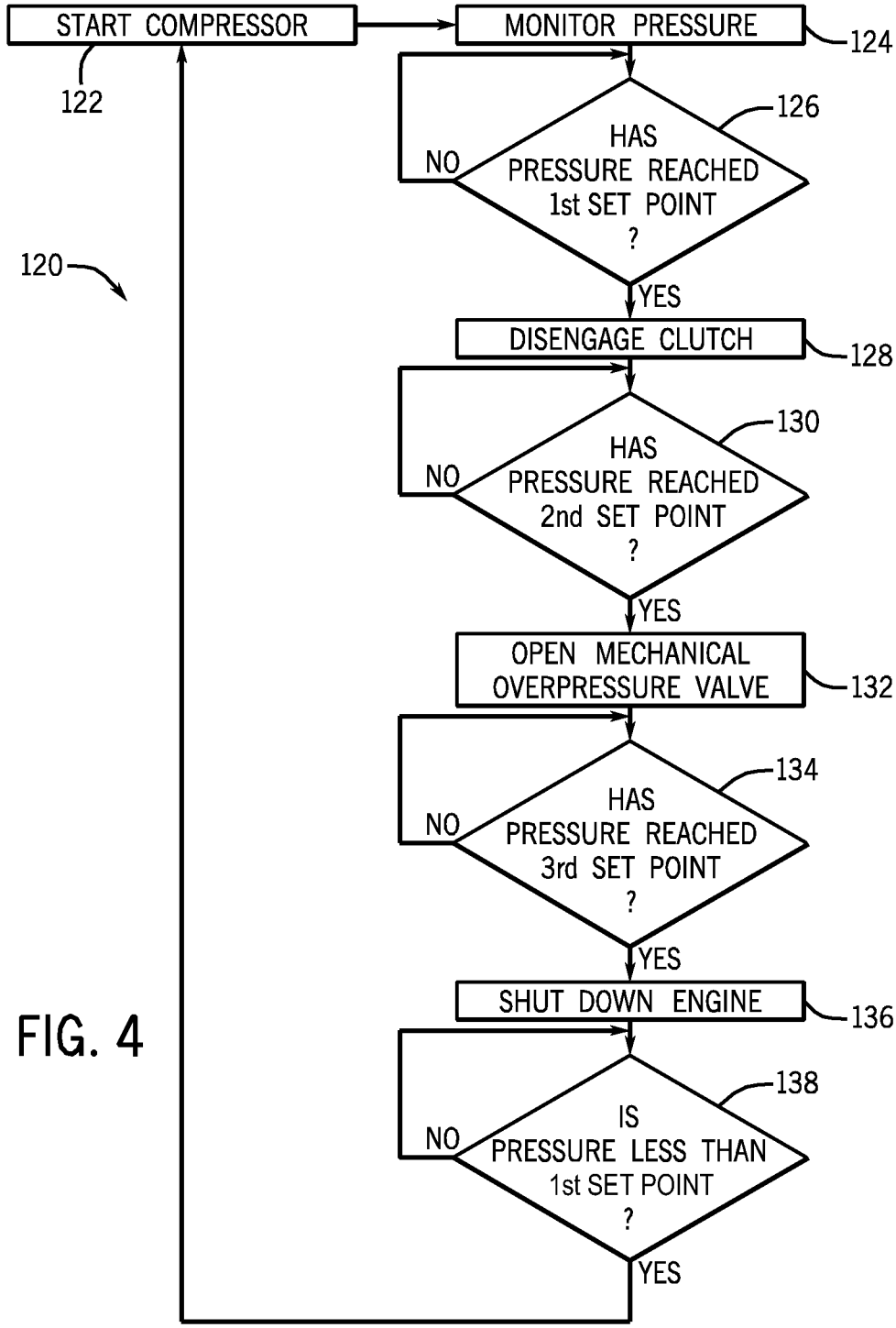
FIG. 4 is a process flow diagram of an embodiment of a method for controlling overpressure of a compressor to prevent compressor malfunction.

It should be noted that situations may arise in which disengagement of the clutch 62 may fail, in which case air compression and therefore pressure buildup continue. To account for such situations, the present embodiments also provide a method 120 including several fail-safe mechanisms to prevent overpressure and compressor malfunction or damage. The method 120 is illustrated as a process flow diagram in FIG. 4. Further, it should be noted that the preliminary steps of the method 120 leading to the fail-safe measures may be substantially the same as those steps presented in method 100 illustrated in FIG. 3. The method 120 begins with starting the compressor 20 (block 122), for example using a keyed ignition, a start button, or a pulley. After the compressor 20 is started (block 122), the compressor 20 begins compressing intake air and the pressure within the compressor 20 is monitored (block 124). According to present embodiments, the pressure within the compressor 20 is measured throughout the method 120, such as by a pressure transducer that provides an electrical signal that is substantially linear with detected pressure.

The pressure within the compressor 20 may be substantially continuously monitored (block 124), such that the compressor 20 (e.g., the control circuitry 64 in FIG. 2) may also substantially continuously perform a determination as to whether the pressure has reached a first set point (query 126), as described above with respect to FIG. 3. For example, the first set point may be between approximately 120 and 190 PSI (e.g., approximately 120, 130, 140, 150, 160, 170, 180, or 190 PSI). In embodiments where the compressor 20 has not reached the first set point, the method 120 returns to monitoring pressure (block 124). However, in embodiments where the pressure has indeed reached or exceeded the first set point, the method 120 may provide for the clutch 62 to be disengaged (block 128). As noted above, the pressure is substantially continuously monitored. Indeed, such substantially continuous monitoring may enable a further determination as to whether the pressure within the compressor 20 has continued to rise, for example to a second set point (query 130). The second set point, of course, may be higher than the first set point. As an example, the second set point may be higher than the first set point by approximately 5, 10, 15, or 20%. In some embodiments, the second set point may be between approximately 190 and 220 PSI (e.g., approximately 190, 200, or 210 PSI).

In embodiments where the pressure has not reached the second set point, such as if the clutch 62 indeed disengages, then the pressure continues to be monitored with no change. However, in embodiments where the pressure has reached or exceeded the second set point, the method 120 may provide for the opening of a mechanical overpressure valve (block 132), such as the pop-off valve 92 in FIG. 2. It should be noted that in certain situations, the mechanical overpressure valve may not release, such as if large amounts of ice have accumulated on the compressor 20.

To provide measures to mitigate the effect of such situations, the method 120 further provides for another determination to be made as to whether the pressure has continued to increase to a third set point (query 134). According to present embodiments, the third set point may be higher than the second set point by approximately 0.5, 1, 2, 5, 10, 15, 20% or more. In embodiments where the pressure has not increased, such as if the opening of the mechanical overpressure valve (block 132) is successful in controlling the overpressure situation, the method 120 may provide for continued pressure monitoring. However, if the opening of the mechanical overpressure valve fails or is insufficient to control the overpressure situation, then the method provides for the compressor 20 to be shut down, such as by shutting down the service engine 16 (block 136). It should be noted that in shutting down the power provided to the compressor 20, that some or all function of the compressor 20 may be lost, which may require a user's attention. For example, a user may have to clear ice from a valve or opening, or activate an air tool to reduce pressure within the compressor, and so on.

While the electrical power to the compressor 20 may be lost, the gauges, such as pressure gauge 72 may enable the user to determine whether the pressure has dropped below the first set point (query 138). For example, the user may use an air tool that is driven by the compressed air within the compressor 20, which may reduce the pressure within the compressor 20. Accordingly, the gauge 72 may enable the user to determine whether the pressure has fallen below the first set point. In embodiments where the pressure has not fallen below the first set point, then the compressor 20 may remain off. However, if the user is able to utilize or release sufficient compressed air so as to reduce the pressure to below the first set point, then the user may re-start the compressor 20 (i.e., restart the engine 16). While such final acts may be performed by the user, it should be noted that the pressure transducer 88 and electronic control 64 may be battery operated or may have a source of power that is separate from the compressor 20. As such, the final acts of query 138 and re-starting the compressor 20 (block 122) may be performed substantially automatically.

While only certain features of the invention have been illustrated and described herein, many modifications and changes will occur to those skilled in the art. It is, therefore, to be understood that the appended claims are intended to cover all such modifications, changes, and combinations as fall within the true spirit of the invention.

The invention claimed is:

1. A system, comprising:

a motor;

a compressor comprising a compression device configured to increase a pressure of a gas;

a clutch configured to selectively transfer torque from the motor to the compressor to drive the compression device; and a controller configured to monitor feedback indicative of the pressure of the gas in the compressor, wherein the controller is configured to perform a first control action configured to reduce the possibility of overpressurization of the compressor if the pressure of the gas in the compressor meets or exceeds a first threshold pressure and a second control action configured to reduce the possibility of overpressurization of the compressor if the pressure of the gas in the compressor meets or exceeds a second threshold pressure, wherein the first and second control actions are different, and the first and second pressures are different.

2. The system of claim 1, wherein the controller is configured to disengage the clutch if the pressure of the gas in the compressor meets or exceeds the first threshold pressure without opening an overpressure valve and without shutting down the motor.

3. The system of claim 1, wherein the controller is configured to engage the clutch if the pressure of the gas in the compressor is at least below the first threshold pressure.

4. The system of claim 3, wherein the controller is configured to engage the clutch if the pressure of the gas in the compressor is at least approximately 5 percent below the first threshold pressure.

5. The system of claim 1, comprising a sensor configured to obtain feedback indicative of the pressure of the gas in the compressor, wherein the controller is configured to compare the feedback indicative of the pressure with the first threshold pressure.

6. The system of claim 1, comprising a heater configured to selectively heat the compressor to reduce or prevent a low temperature freeze condition.

7. The system of claim 1, wherein the controller is configured to disengage the clutch if the pressure of the gas in the compressor meets or exceeds the first threshold pressure, and wherein the compressor comprises an overpressure valve configured to open if the pressure of the gas in the compressor meets or exceeds the second threshold pressure, and the second threshold pressure is greater than the first threshold pressure.

8. The system of claim 7, wherein the compressor comprises an overpressure switch, the controller is configured to trigger the overpressure switch to shut off the motor if the pressure of the gas in the compressor meets or exceeds a third threshold pressure, and the third threshold pressure is greater than the second threshold pressure.

9. The system of claim 1, comprising a self-contained service pack having the motor, the compressor, the clutch, and the controller.

10. The system of claim 9, wherein the self-contained service pack comprises an electrical generator.

11. A system, comprising:

a compressor control system having an overpressure controller, wherein the overpressure controller is configured to perform a control routine based on a comparison of feedback indicative of a pressure of a gas in a compressor with at least a first and a second threshold pressure, and the control routine causes the controller to perform a first control action based on the comparison if the pressure of the gas meets or exceeds the first threshold pressure and a second control action based on the comparison if the pressure of the gas meets or exceeds the second threshold pressure;

wherein the second threshold pressure is higher than the first threshold pressure, the first and second control actions are different, and either of the first and second control actions comprise selectively engaging and disengaging a clutch between a motor and the compressor, opening an overpressure valve of the compressor, or shutting off the motor.

12. The system of claim 11, wherein the overpressure controller is configured to disengage the clutch if the pressure meets or exceeds the first threshold pressure.

13. The system of claim 12, wherein the overpressure controller is configured to disengage the clutch if the pressure meets or exceeds the first threshold pressure without opening the overpressure valve and without shutting down the motor.

14. The system of claim 12, wherein the overpressure controller is configured to engage the clutch if the pressure is at least below the first threshold pressure.

15. The system of claim 11, wherein the compressor control system comprises a heater controller configured to selectively engage a heater to add heat to the compressor to reduce or prevent a low temperature freeze condition.

16. The system of claim 11, wherein the compressor control system comprises at least one overpressure indicator configured to output a user perceivable indication of an overpressure condition based on feedback indicative that the pressure has met or exceeded either of the first or second threshold pressures.

17. The system of claim 11, comprising the motor, the clutch, the compressor, and the controller in a self-contained portable service pack.

18. A method, comprising:

selectively disengaging a clutch between a motor and a compressor if a sensed pressure meets or exceeds a first threshold pressure in the compressor;

selectively engaging the clutch if the sensed pressure is at least less than the first threshold pressure in the compressor; and opening an overpressure valve of the compressor if the sensed pressure meets or exceeds a second threshold pressure in the compressor, wherein the second threshold pressure is higher than the first threshold pressure, wherein selectively disengaging the clutch if the sensed pressure meets or exceeds the first threshold pressure in the compressor excludes opening the overpressure valve and excludes shutting down the motor.

19. The method of claim 18, comprising outputting a user perceivable indication of an overpressure condition in the compressor if the sensed pressure meets or exceeds the first threshold pressure in the compressor.

* * * * *